United States Patent [19]

Burkhart

[11] Patent Number: 4,557,001

[45] Date of Patent: Dec. 10, 1985

[54] SKIMMING DEVICE FOR SWIMMING POOL

[76] Inventor: Scott C. Burkhart, 1155 Innsbruck St., Livermore, Calif. 94550

[21] Appl. No.: 557,028

[22] Filed: Dec. 1, 1983

[51] Int. Cl.[4] ..... E04H 3/20

[52] U.S. Cl. ..... 4/490; 4/496; 210/169

[58] Field of Search ..... 4/487, 488, 490, 496; 210/169, 923; 15/1.7; 43/14

[56] References Cited

U.S. PATENT DOCUMENTS

| | | | |
|---|---|---|---|
| 2,367,997 | 1/1945 | Chambers | 4/490 |
| 3,699,700 | 10/1972 | Kinsell | 43/14 |
| 3,998,060 | 12/1976 | Preus | 210/923 |
| 4,053,412 | 10/1977 | Stix | 210/169 |
| 4,068,327 | 1/1978 | Heinlein | 210/169 |
| 4,089,074 | 5/1978 | Sermons | 4/490 |
| 4,152,801 | 5/1979 | Lieber | 210/169 |

*Primary Examiner*—Stephen Marcus
*Assistant Examiner*—Linda J. Sholl
*Attorney, Agent, or Firm*—Townsend and Townsend

[57] ABSTRACT

A skimming device for removing debris from the water surface of a swimming pool is formed from a skirt member of net material. Buoyancy material is mounted on the one edge margin of the skirt member and weights are mounted on the opposite edge margin of the skirt member. Thus, the skirt member is a vertical orientation when it is in the water of a swimming pool. One or both ends of the skirt member is provided with a bar to which a handle can be releasably connected. Movement of the ends of the skirt member relative to each other along the peripheral margin of the swimming pool causes the skirt member to be moved in a manner to skim the entire water surface and eventually to form a loop which traps debris which normally floats on or near the surface of the water. Then, by pulling the skirt member while it is in the form of a loop out of the pool, the debris is removed quickly and easily from the swimming pool itself. The skirt member can then be washed with a garden hose and air dried for use at a later time.

9 Claims, 6 Drawing Figures

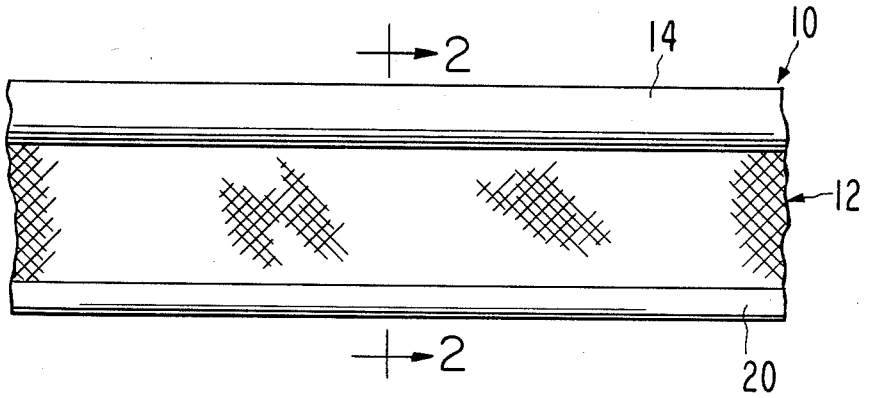
FIG. 1
FIG. 2
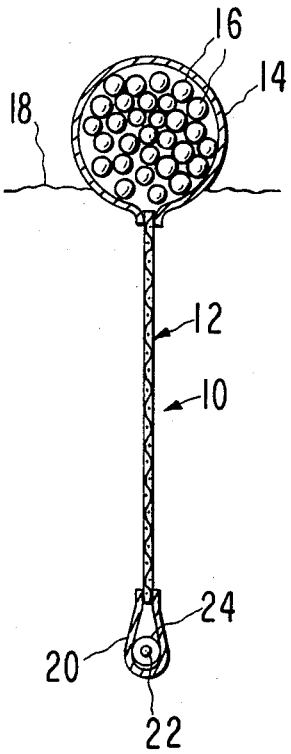
FIG. 3
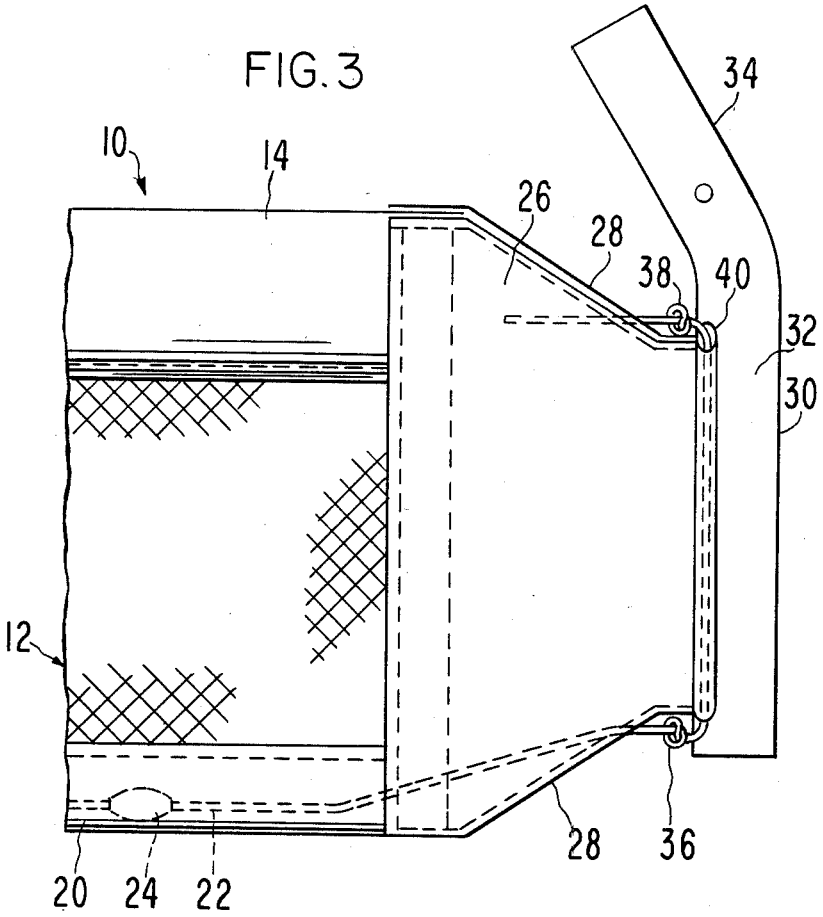

SKIMMING DEVICE FOR SWIMMING POOL

This invention relates to improvements in the cleaning of swimming pools and, more particularly, to an improved skimmer device for cleaning debris which normally floats on the surface of the water of a swimming pool.

BACKGROUND OF THE INVENTION

Skimming devices for swimming pools have been known and used in the past. Such devices include leaf rakes or automatic skimmers powered by the circulation system of a pool. Generally, a leaf rake must be manually handled by an attendant for at least 15 minutes to properly skim the debris from the top of a backyard swimming pool of average size. In many cases, the automatic skimmers require that the filter pump of a pool be operating for at least one hour or more. Even after such effort has been expended, a diluted yet significant amount of dirt still remains on the surface of the water. Moreover, many pools do not have an effective water circulation system so as to make an automatic skimmer work properly. Because of these drawbacks, a need exists for an improved water skimming device and technique which minimizes cleaning time with a minimum expenditure of effort.

Prior disclosures in the field of skimming of water surfaces include the following U.S. Patents:

U.S. Pat. No. 4,006,082
U.S. Pat. No. 4,053,412
U.S. Pat. No. 4,089,074
U.S. Pat. No. 4,356,088

For the most part, the foregoing patents relate to the separation of oil from water using imperforate skimming devices. Generally, these devices are not suitable for skimming particulate debris from the upper surface of the water of a swimming pool.

SUMMARY OF THE INVENTION

The present invention satisfies the aforesaid need by providing an improved skimming device suitable for backyard swimming pools and the like wherein the skimming device is simple and rugged in construction, is easily made at minimum cost, and can be properly used with substantially no skills on the part of the user. To this end, the skimming device of the present invention includes a perforate skirt of net or other material having a buoyancy means on the upper margin thereof and weight means on the lower margin thereof. Thus, when the skirt member is in the water, it will be in a vertical orientation so that, as one end of the skirt member is held in a fixed position near the side of a swimming pool, the other end of the skirt member can be shifted along the periphery of the pool and into the form of a loop, trapping debris within the loop. with two persons, both ends can be moved by the two persons along the periphery until they meet, again forming a loop and trapping the debris. By removing the loop from the water, the debris is pulled or skimmed off the water surface and out of the swimming pool to a location where it can be discarded. The skirt member can then be cleaned by a garden hose or other means and then hung for air drying.

The skimming device of the present invention is a convenient, low-cost means to skim leaves, dirt and other floating debris from a pool's surface. The device works on the principal that most of the debris which floats on the surface will remain floating while the device is in operation.

The primary object of the present invention is to provide an improved skimming device and method of skimming the upper surface of a swimming pool wherein the device includes a perforate skirt which is moved over the surface of a swimming pool in such a manner so as to trap debris normally floating on the surface, whereby the debris can then be pulled off the surface of the water while the debris remains trapped, all of which can be done quickly and easily and without special skills on the part of the user of the device.

Other objects of this invention will become apparent as the following specification progresses, reference being had to the accompanying drawings for an illustration of the invention.

IN THE DRAWINGS:

FIG. 1 is a fragmentary side elevational view of the water skimming device of the present invention;

FIG. 2 is an enlarged, cross-sectional view taken along line 2—2 of FIG. 1;

FIG. 3 is an enlarged, fragmentary side elevational view showing one end of the skimming device.

Figure 4:
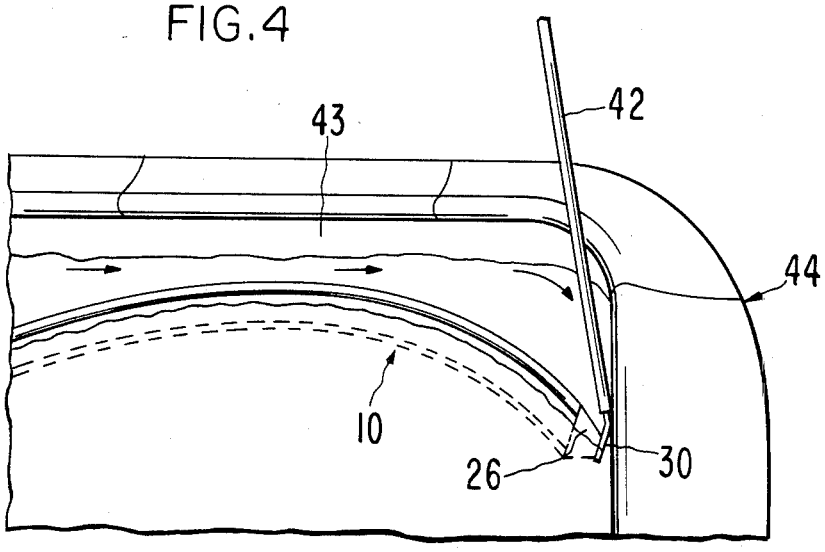
FIGS. 4–6 are fragmentary, perspective views of a swimming pool showing the sequence of steps in using the skimming device of the present invention.

A preferred embodiment of the skimming device of the present invention is broadly denoted by the number 10 and includes a flexible, perforate skirt member 12 formed from a net material such as nylon or acetate and having a length depending upon the size of swimming pool whose surface is to be skimmed by device 10. For instance, the length of member 12 could be in a range of 20′ to 40′ or more for a backyard swimming pool. However, the length of body 12 could be much greater for public swimming pools and the like. Device 10 is not limited to any particular size of pool and is suitable for all types of swimming pools. A typical width of member 12 is 5 to 7 inches.

Skirt member 12 has means at the upper margin thereof for providing buoyancy therefor and weight means at the lower margin thereof to apply a downward force thereto. Thus, the skirt member will be supported in the water in a vertical orientation as shown in FIG. 2.

The buoyancy means at the upper margin of skirt member 12 includes a tubular, flexible element 14 which typically is a nylon or acetate fabric. Element 14 is made from a single sheet of material and is doubled upon itself and stitched or otherwise secured at its ends to the upper margin of skirt member 12 as shown in FIG. 2. Element 14 contains buoyant material which, for purposes of illustration, includes particles or small pieces 16 of a suitable low density material, such as foam plastic or polystyrene. The low density material could be a one-piece construction if a suitable material is available for this purpose. The amount of buoyant material typically is sufficient to support the skirt member 12 in a manner such that the surface of the water, denoted by the numeral 18 in FIG. 2, is slightly above the upper margin of skirt member 12 when device 10 is in an operative position in a swimming pool or the like.

The weight means at the lower margin of skirt member 12 includes a tubular, flexible body 20 initially formed from a flat sheet of material, such as nylon or acetate fabric or by the perforate skirt material 12 itself. The sheet is doubled upon itself and stitched or otherwise secured to the lower margin of the skirt member to form an interior space suitable for receiving a flexible line 22 having a number of spaced, lead weights 24 thereon as shown in FIGS. 2 and 3. Other weight means could be provided, if desired.

Each end of skirt member 12 is provided with a laterally projecting, flexible wall 26 of fabric, such as nylon or acetate, the wall being secured by stitching or other means to the adjacent end of skirt member 12. Wall 26 has converging upper and lower edges 28 which terminate at an end margin secured in any suitable manner to a tubular bar 30 typically of plastic and having a main segment 32 and an end segment 34 extending at an angle from the normally upper end of segment 32. For purposes of illustration, segment 32 can be provided with a slot along the length thereof for receiving the end margin of wall 26, such end margin having eyelet means for receiving the adjacent end of line 22 as shown in FIG. 3. The line 22 is provided with a first knot 36 at the lower end before the line enters bar 30, and a second knot 38 at the upper end after emerging from a hole 40 in bar 30. This attachment means allows some relative movement between wall 26 and bar 30. The upper end segment 34 of bar 30 is adapted to receive a handle 42 (FIGS. 4–6) to allow the adjacent end of device 10 to be manually moved about the inner peripheral surface 43 of a swimming pool 44.

Figure 5:
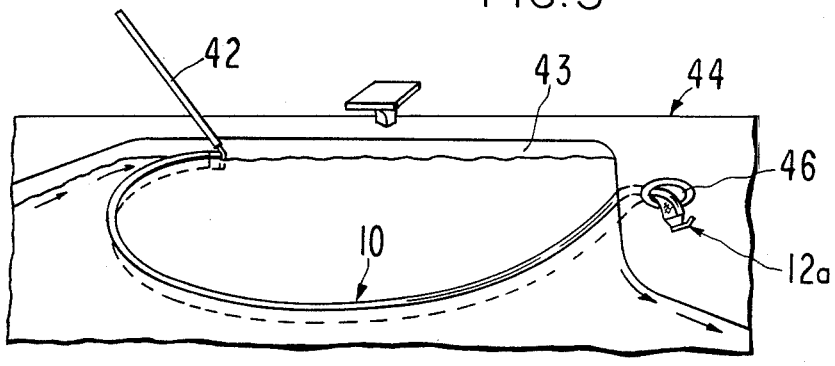
Figure 6:
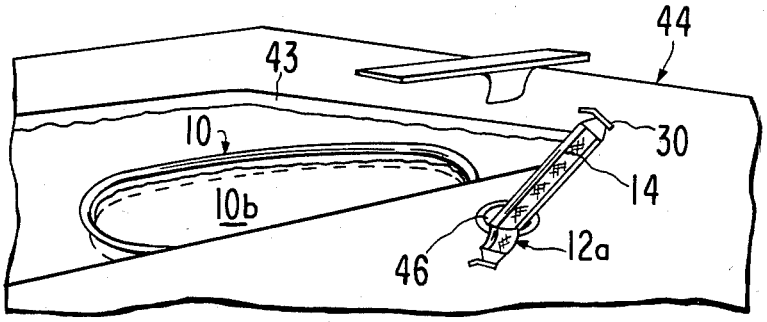

To illustrate the way in which device 10 is used, reference is made to FIGS. 4–6. Initially, the device is placed in a bundle at poolside or on the surface of the water adjacent to the opening at the side wall 43 of the pool which leads to the filter pump of the pool. This opening is adjacent to an access porthole 46 (FIGS. 5 and 6) which has a skimmer basket therewithin. The porthole 46 is initially opened up by removing the cover thereof, and the filter pump of the pool is actuated. For better results, the suction regulator beneath the skimmer basket can also be removed to maximize the water flow to the filter pump.

Next, one end of the skimmer device is inserted into the side opening and pulled manually out of porthole 46 as shown in FIG. 5. This end of skirt member 12, denoted by the numeral 12*a*, is then laid on the surface adjacent to porthole 46.

The opposite end of the skimmer device is then provided with handle 42 and the device is manually moved against the peripheral wall 43 of the swimming pool, beginning on one side of the opening in the pool wall 43 leading to the skimmer basket and filter pump. The movement of the opposite end of the skimmer device follows the arrows shown in FIGS. 4–6. A person holding the handle 42 forces bar 30 against the side wall 43 of the pool above and below the water surface to scrape debris clinging to the side wall. This action continues around substantially the entire periphery of the pool and ends at the opposite side of the opening in side wall 43. FIG. 4 shows the way in which tube 30 engages the side wall 43 of the pool and the way in which a turn is made in the movement of the leading end of skimmer device 10. FIG. 5 shows the skimmer device after having been moved throughout a major portion of the area of the pool and how it is commencing to form a loop; and FIG. 6 shows one of the final steps performed in removing the debris from the pool with the loop almost closed.

As the skimmer device 10 moves along the surface of the pool, it collects debris floating on the surface yet allows water to flow through the skirt member 12 which would otherwise create turbulence in advance of the device if the skirt were imperforate. Such turbulence would cause the debris to escape, usually sinking. Moreover, the mesh of skirt member 12 is sufficiently fine to allow penetration of the water while effectively trapping particles of debris which are on the water surface.

When the opposite end of the skimmer device reaches the opening in side wall 43, the handle 42 is removed from bar 30 and the bar is inserted through the side opening and then outwardly through porthole 46 as shown in FIG. 6. Then, the two end bars 30 are pulled simultaneously away from porthole 46 as the filter pump motor continues in operation. The floating debris is trapped in the loop area denoted by the numeral 10*b* (FIG. 6) and is pulled completely out of the water, through and out of the side opening and porthole 46. Some of the debris is drawn by suction into the filter basket toward the filter pump while the major portion of the debris remains clinging to device 10 and is pulled outwardly therewith through porthole 46. Device 10 can then be washed with a garden hose and put away for air drying. Any debris in the skimmer basket can be removed, and the suction regulator and a pool sweep, if one is used, can be put back in the pool. The entire cleaning process using device 10 for a backyard swimming pool of average size requires less than five minutes of movement of the device about the pool itself.

What is claimed is:

1. A skimmer device for a swimming pool having a side wall opening leading to an access porthole on the surface adjacent to the swimming pool comprising:
   - a perforate skirt member having an upper margin and a lower margin;
   - means on the upper margin of the skirt member for rendering the same buoyant near the upper surface of the water in a swimming pool;
   - means on the lower margin of the skirt member for applying a downward force thereto, whereby the skirt member will be oriented in the water with the upper margin thereof above the lower margin; and
   - a handle coupled to one end of the skirt member for manually moving said one end of the skirt relative to the other end along the side wall of the swimming pool as the other end of the skirt is substantially in a fixed position near said side wall opening to thereby cause the skirt member to be moved in a manner to form a loop to trap debris, said skirt member, said rendering means and said force applying means being sufficiently flexible to allow the ends of the skirt member to be inserted into the side wall opening and through and out of said access porthole so that the skirt member may be pulled out of the swimming pool, through the side wall opening and through and out of the access porthole to decrease the size of said loop, whereby debris on the surface of the water may be removed from the water by removal of the skirt in the form of said loop from the water.

2. A skimmer device as set forth in claim 1, wherein the skirt member is a mesh material.

3. A skimmer device as set forth in claim 1, wherein said means on the upper margin of the skirt member includes a tubular element having buoyant material therewithin.

4. A skimmer device as set forth in claim 3, wherein said tubular element comprises a fabric sheet folded upon itself and secured at the ends thereof to the upper margin of the skirt member.

5. A skimmer device as set forth in claim 1, wherein said handle includes a rigid bar.

6. A skimmer device as set forth in claim 5, wherein is provided a fabric wall secured to each end, respectively, of the skirt member, said wall having an outer end coupled to the bar.

7. A method of skimming debris from the upper surface of a swimming pool comprising:

providing an elongated perforate skirt member capable of floating on the surface of the water of a swimming pool and of extending downwardly from the water surface in a substantially vertical direction;

moving the ends of the skimmer member relative to each other and along the outer periphery of the pool until the skirt member forms a loop; and removing the skirt member in the form of the loop from the water to thereby cause removal of the debris from the surface of the water.

8. A method as set forth in claim 7, wherein the removing step includes moving the skirt member laterally of the pool while progressively reducing the size of the loop.

9. A method as set forth in claim 7, wherein said removing step includes pulling the skirt member through a side opening in the pool.

* * * * *